US005570648A

United States Patent [19]

Burt et al.

[11] Patent Number: 5,570,648

[45] Date of Patent: Nov. 5, 1996

[54] WAIST BAND-FORMING APPARATUS AND METHOD

[75] Inventors: Donald E. Burt, Danvers, Mass.; James R. Mazur, Londonderry, N.H.

[73] Assignee: Design Technology Corporation, Billerica, Mass.

[21] Appl. No.: 354,673

[22] Filed: Dec. 13, 1904

[51] Int. Cl.[6] ..... D05B 35/02; D05B 35/06

[52] U.S. Cl. ..... 112/470.33; 112/475.12; 112/305

[58] Field of Search ..... 112/475.01, 475.12, 112/475.13, 152, 470.33, 309, 311, 152, 305, 322, 475.06, 470.34

[56] References Cited

U.S. PATENT DOCUMENTS

| | | | |
|---|---|---|---|
| 3,507,234 | 4/1970 | Bryan | 112/470.33 |
| 3,780,679 | 12/1973 | Hanes, Jr. et al. | 112/470.33 |
| 3,792,627 | 2/1974 | Friedman et al. | 112/104 |
| 4,191,117 | 3/1980 | Della Torre | 112/470.33 X |
| 4,366,764 | 1/1983 | McCurry, III | 112/470.33 |
| 5,127,349 | 7/1992 | Nakamura et al. | 112/470.33 |
| 5,417,174 | 5/1995 | Allison et al. | 112/470.34 X |

*Primary Examiner*—Ismael Izaguirre
*Attorney, Agent, or Firm*—Rhodes Coats & Bennett, L.L.P.

[57] ABSTRACT

An apparatus for forming and sewing a waist band to complete a pair of briefs. The apparatus includes a band maker for forming the waist band. The apparatus also includes at least one sewing machine adapted to receive the waist band and a pair of briefs and to sew the waist band onto the pair of briefs. A band inverter and loader transfers the waist band from the band maker to the sewing machine. Finally, a transfer assembly transfers the pair of briefs from an upstream work station to the sewing machine where the waist band and pair of brief are sewn together.

33 Claims, 13 Drawing Sheets

| FIG. 1A |
|---|
| FIG. 1B |

WAIST BAND-FORMING APPARATUS AND METHOD

BACKGROUND OF THE INVENTION

1. Field of the Invention

The present invention relates generally to automated manufacturing systems and, more particularly, to an apparatus for joining front and rear fabric panels to a waist band to form a pair of men's briefs or the like.

2. Description of the Prior Art

The manufacture of textile clothing articles such as briefs, tee-shirts, and other garments has resisted automation. This is due largely because of the difficulty in accurately positioning so called "soft" materials. For example, the knitted material commonly used in briefs and tee-shirts may wrinkle, stick to one another and stretch significantly when handled.

One technique which has been somewhat successful has been the introduction of fiber optic edge detectors. Such detectors, when attached to a sewing machine and guide means can allow some automation of common sewing operations such as binding an edge of a pre-cut fabric piece. However, such operations still require the use of a skilled operator to feed the fabric piece to the sewing machine and usually carry out only one sewing operation at a time.

Thus, there remains a need for an apparatus for joining front and rear fabric panel to a waist band to form a pair of men's briefs or the like which can be carried out completely automatically without the need for a skilled operator.

SUMMARY OF THE INVENTION

The present invention is directed to an apparatus for forming and sewing a waist band to complete a pair of briefs. The apparatus includes a band maker for forming the waist band. The apparatus also includes at least one sewing machine adapted to receive the waist band and a pair of briefs and to sew the waist band onto the pair of briefs. A band inverter and loader transfers the waist band from the band maker to the sewing machine. Finally, a transfer assembly transfers the pair of briefs from an upstream work station to the sewing machine where the waist band and pair of briefs are sewn together.

In the preferred embodiment, the band maker includes means for supplying a predetermined length of elastic band; a pair of counter rotating band grippers for receiving the predetermined length of elastic band from the supply and rotating to position the ends of the predetermined length of elastic band in end-to-end relationship with respect to one another; and means for joining the ends of the predetermined length of elastic band.

Accordingly, one aspect of the present invention is to provide an apparatus for forming and sewing a waist band to complete a pair of briefs. The apparatus includes: (a) a band maker for forming the waist band; (b) at least one sewing machine adapted to receive the waist band and a pair of briefs and to sew the waist band onto the pair of briefs; and (c) a band inverter and loader for transferring the waist band from the band maker to the sewing machine.

Another aspect of the present invention is to provide an apparatus for forming a waist band. The apparatus includes: (a) means for supplying a predetermined length of elastic band; (b) a pair of counter rotating band grippers for receiving the predetermined length of elastic band from the supply and rotating to position the ends of the predetermined length of elastic band in end-to-end relationship with respect to one another; and (c) means for joining the ends of the predetermined length of elastic band.

Still another aspect of the present invention is to provide an apparatus for forming and sewing a waist band to complete a pair of briefs. The apparatus includes: (a) a band maker for forming the waist band, the band maker including: (i) means for supplying a predetermined length of elastic band; (ii) a pair of counter rotating band grippers for receiving the predetermined length of elastic band from the supply and rotating to position the ends of the predetermined length of elastic band in end-to-end relationship with respect to one another; and (iii) means for joining the ends of the predetermined length of elastic band; (b) at least one sewing machine adapted to receive the waist band and a pair of briefs and to sew the waist band onto the pair of briefs; (c) a band inverter and loader for transferring the waist band from the band maker to the sewing machine; and (d) a transfer assembly for transferring the pair of briefs from an upstream work station to the sewing machine.

These and other aspects of the present invention will become apparent to those skilled in the art after a reading of the following description of the preferred embodiment when considered with the drawings.

DESCRIPTION OF THE PREFERRED EMBODIMENTS

Figure 1:
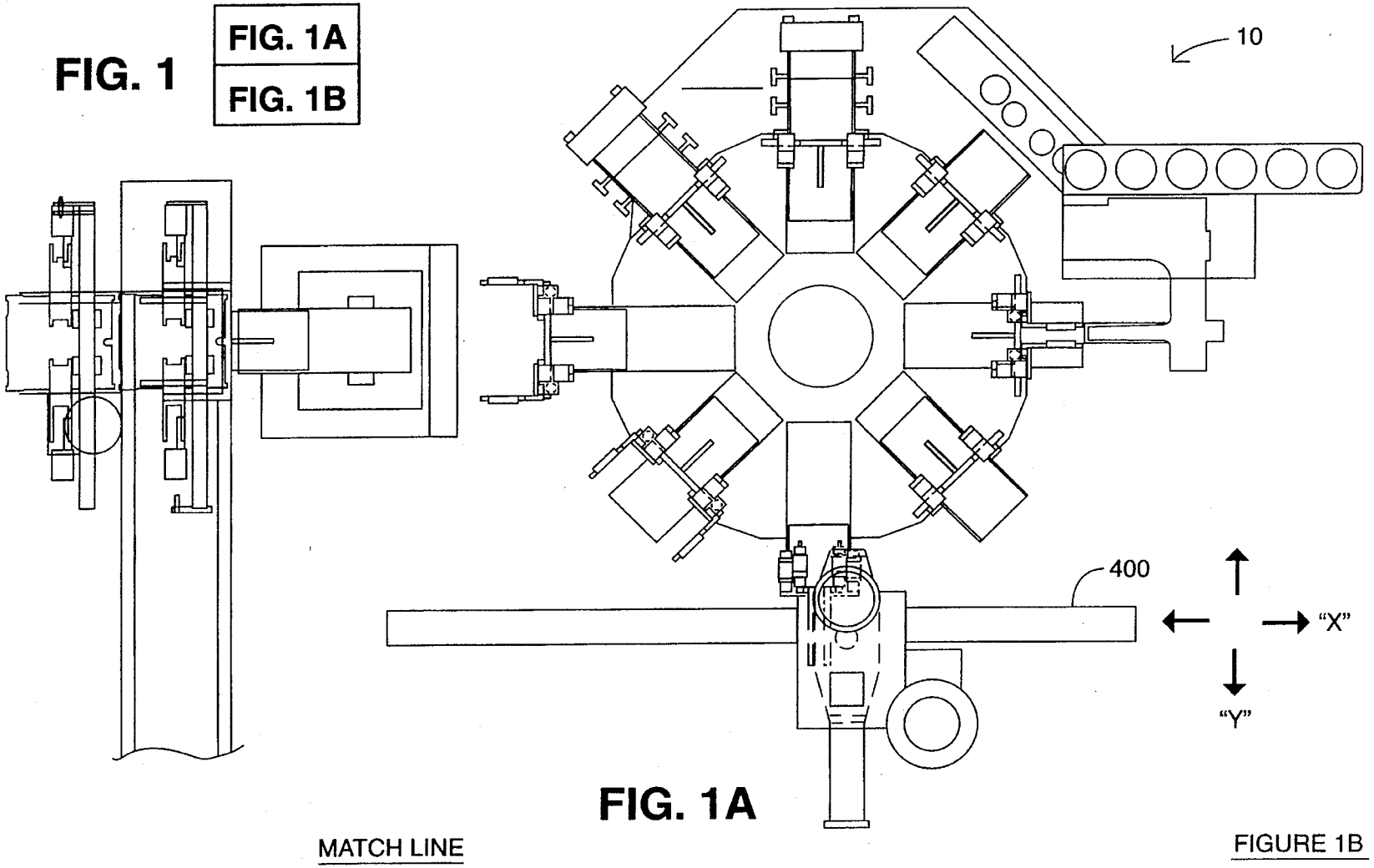
FIG. 1 is a plan view of a sew band station constructed according to the present invention.
Figure 1B:
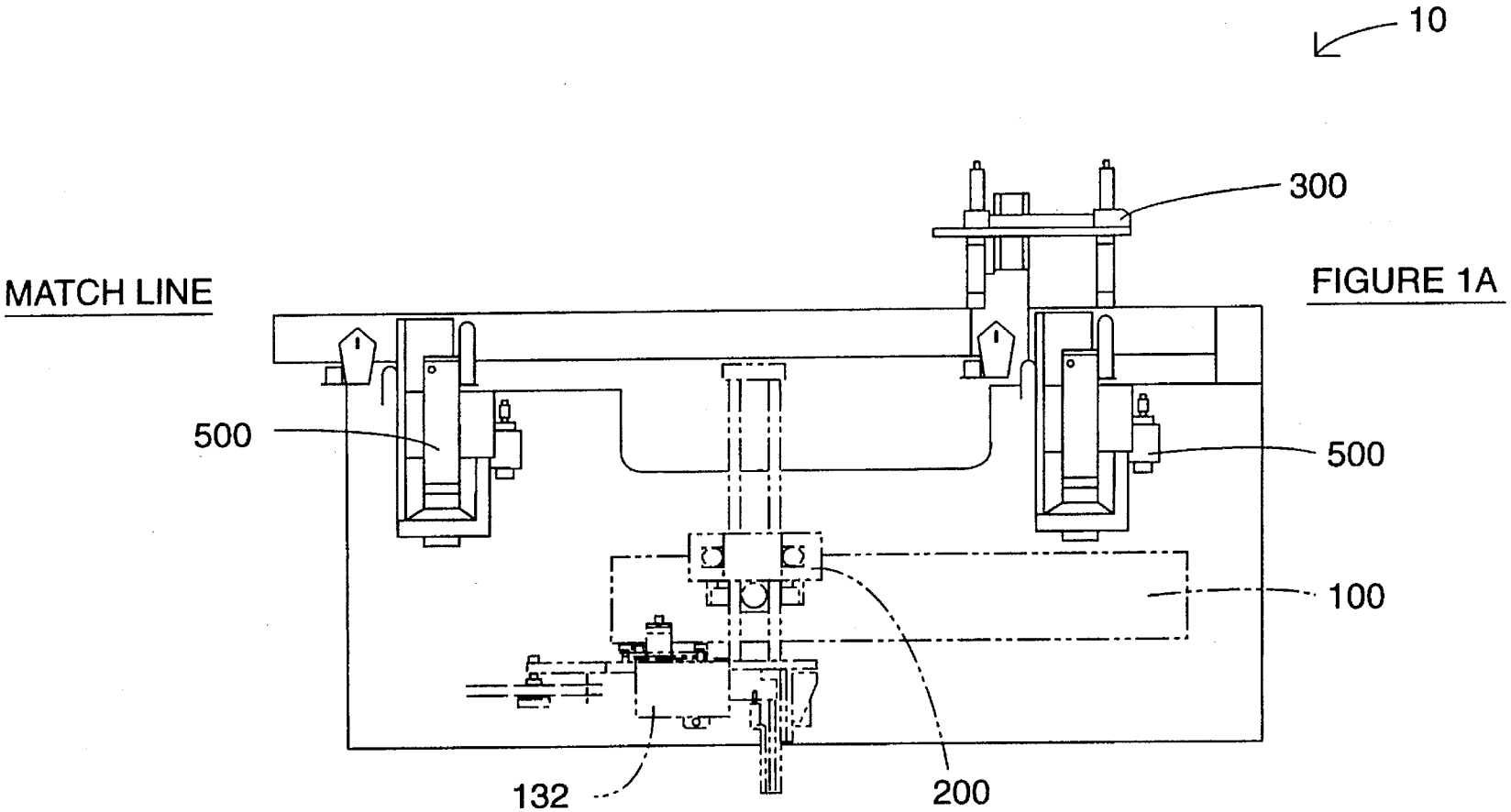
Figure 2A:
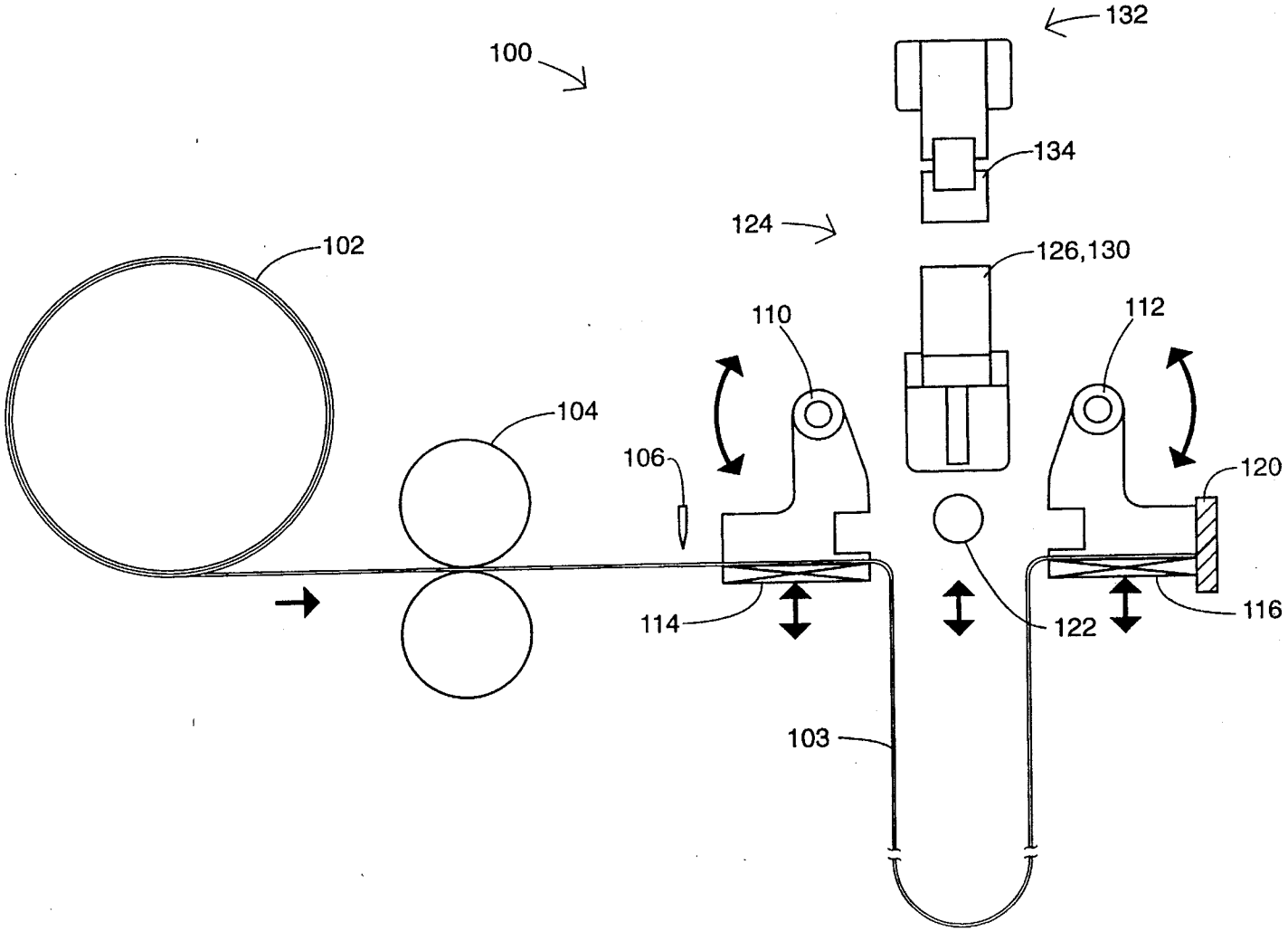
FIGS. 2A–2E illustrate the sequence of operation of the elastic waist band making apparatus shown in FIG. 1.
Figure 2B:
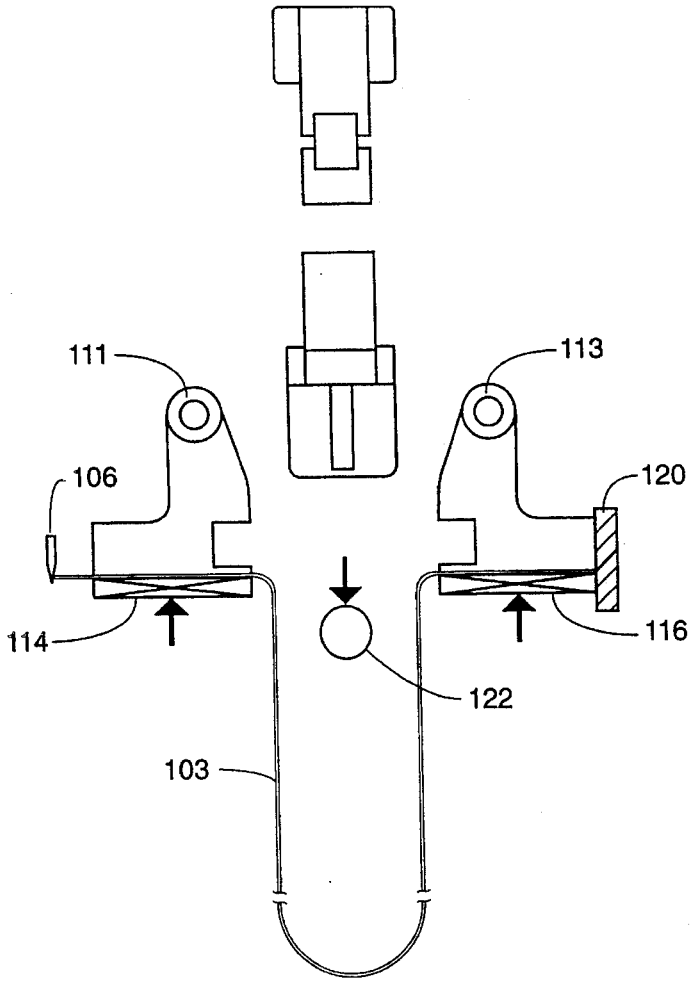
Figure 2C:
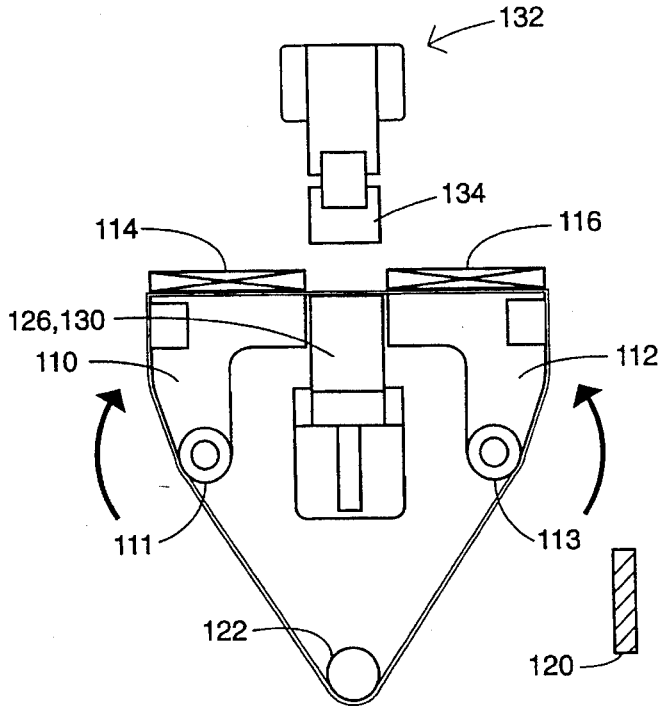
Figure 2D:
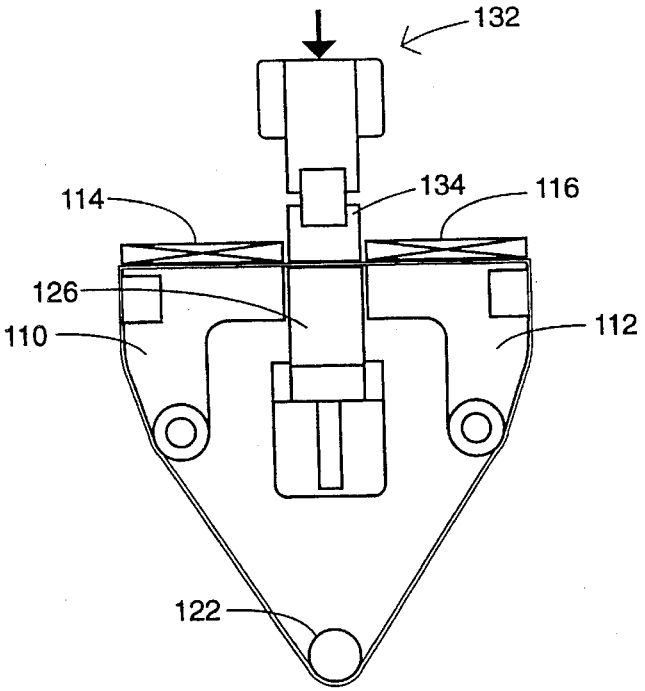
Figure 2E:
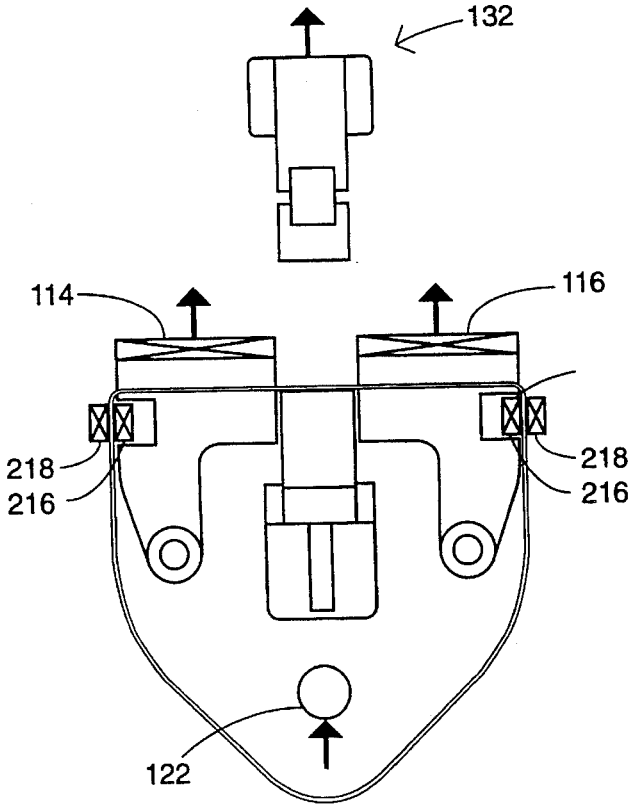

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, there is shown a plan view of a sew band station, generally designated 10, constructed according to the present invention. As can be seen, sew band station 10 includes five major subassemblies: an elastic waist band making apparatus 100; an elastic waist band inverting apparatus 200; an elastic waist band loading apparatus 300; a transfer apparatus 400; and at least one elastic waist band sewing machine 500.

The operation of the individual components may be best understood by a discussion of the operation of the entire system. Generally speaking, elastic waist band making apparatus 100 first produces a waist band of the appropriate size to complete a pair of men's briefs or the like. An inverting apparatus 200 removes the completed waist band from band making apparatus 100 and transfers it to at least one band loading apparatus 300. In the preferred embodiment only a single band loading apparatus is used. However, for higher production capability a pair of band loading apparatuses 300 could be used moving to and from the center to each of the outboard sewing machines 500. Finally in the preferred embodiment, a transfer apparatus 400 removes the partially completed men's brief from an upstream sewing station such as the seam crotch station illustrated for purposes of discussion and rotates and positions the partially completed men's brief with respect to either the first or second sewing machine where the sewing operation can be completed and the elastic waist band is sewn onto the men's brief to complete it.

Referring first to the band making apparatus 100, its operation can be best understood by referring to FIGS. 2A–2E which illustrate the sequence of operation of the elastic waist band making apparatus. Elastic waist band making apparatus 100 includes a source of elastic strip 102 such as a roll for forming a predetermined length of elastic 103 to construct the waist band. The elastic strip is removed from its roll 102 by means of roller drive 104 and when the proper length is reached is cut by cutting apparatus 106. In the preferred embodiment, cutter apparatus 106 is a simple guillotine knife. Also, in the preferred embodiment, a pair of counter-rotating band grippers 110, 112 each grasp one end of the length of elastic band 103. Elastic waist band gripper 110, 112 include an upper frame and a lower opposed jaw 114 and a second opposed upper frame and a lower opposed jaw 116. A fixed band stop 120 prevents the length of band 103 from going past a predetermined position. Also, in the preferred embodiment, an elastic waist band tensioner rod 122 moves downward to contact the midportion of elastic waist band 103 to preload the waist band with a predetermined amount of tension prior to the ends being fused together. This operation controls the position of the band so that it is in a known location when the band inverter clamps enters the band clamps. If the waist band was not tensioned across the openings in the band clamp (see 2C) it would be less likely for the inverter clamps to acquire them with the necessary certainty.

In between the pair of counter-rotating elastic waist band grippers 110, 112 there is located a joining assembly 124. Joining assembly 124 includes a fixed labeler anvil 126 and bottom heater element 130. A label supply means 132 is located above the labeler anvil 126 and is conventional in design. A labeler heater element 134 is located beneath the label supply means 132 to provide heat to fuse the label to the ends of elastic waist band 103.

In operation, the band clamps 110, 112 open and a servo-motor feeds elastic waist band strip to the proper length for a predetermined size of men's brief or the like (2A). Next, the band clamps 110, 112 close and the cutter assembly 106 is activated to cut the proper length of elastic band (2B). In the next step, band clamps 110, 112 are rotated about pivot points 111 and 113 to the band label and seal position. The band is now under light tension due to the movement of the band clamp to position the band clamps and the position of the adjuster rod 122 (2C). In the next step, band inverter clamps (best seen in FIGS. 3 and 4) open and stroke into the band clamps 110, 112 to acquire the elastic waist band. The label is applied and heat sealing is completed when the labeler heater element 134 contacts against the upper surface of heated anvil 126. The band inverter clamps are then closed to acquire band 103 (2D). Finally, the adjuster rod 132 raises to release the tension on elastic waist band and the labeler heater element retracts. The band clamps 114, 116 then open and the band inverter apparatus (best seen in FIGS. 3 and 4) strokes the band clear of band apparatus and inverts the band on transfer to the band loading apparatus 300 (2E).

Figure 3:
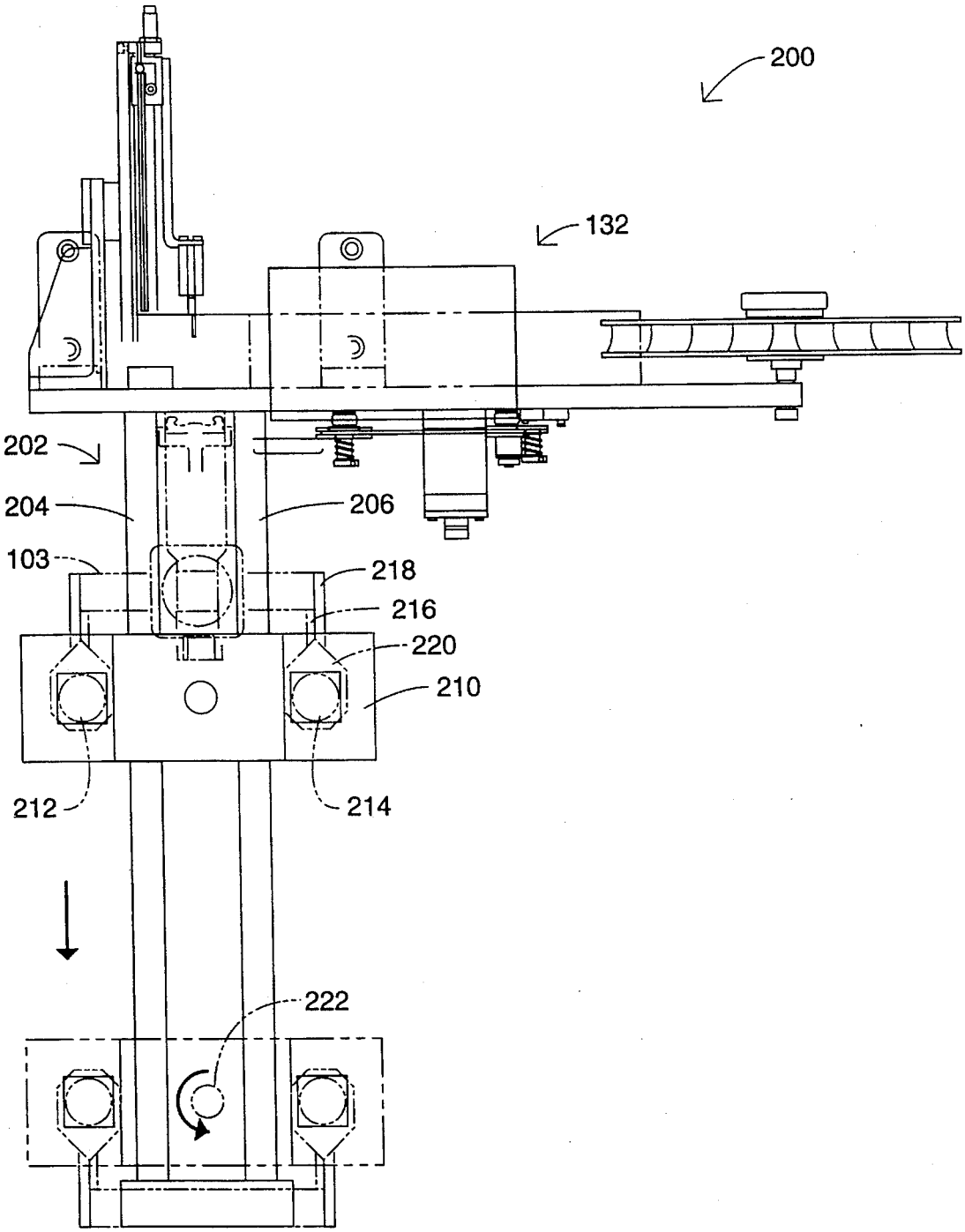
FIG. 3 is an enlarged plan view of the elastic waist band inverting apparatus shown in FIG. 1.
Figure 4:
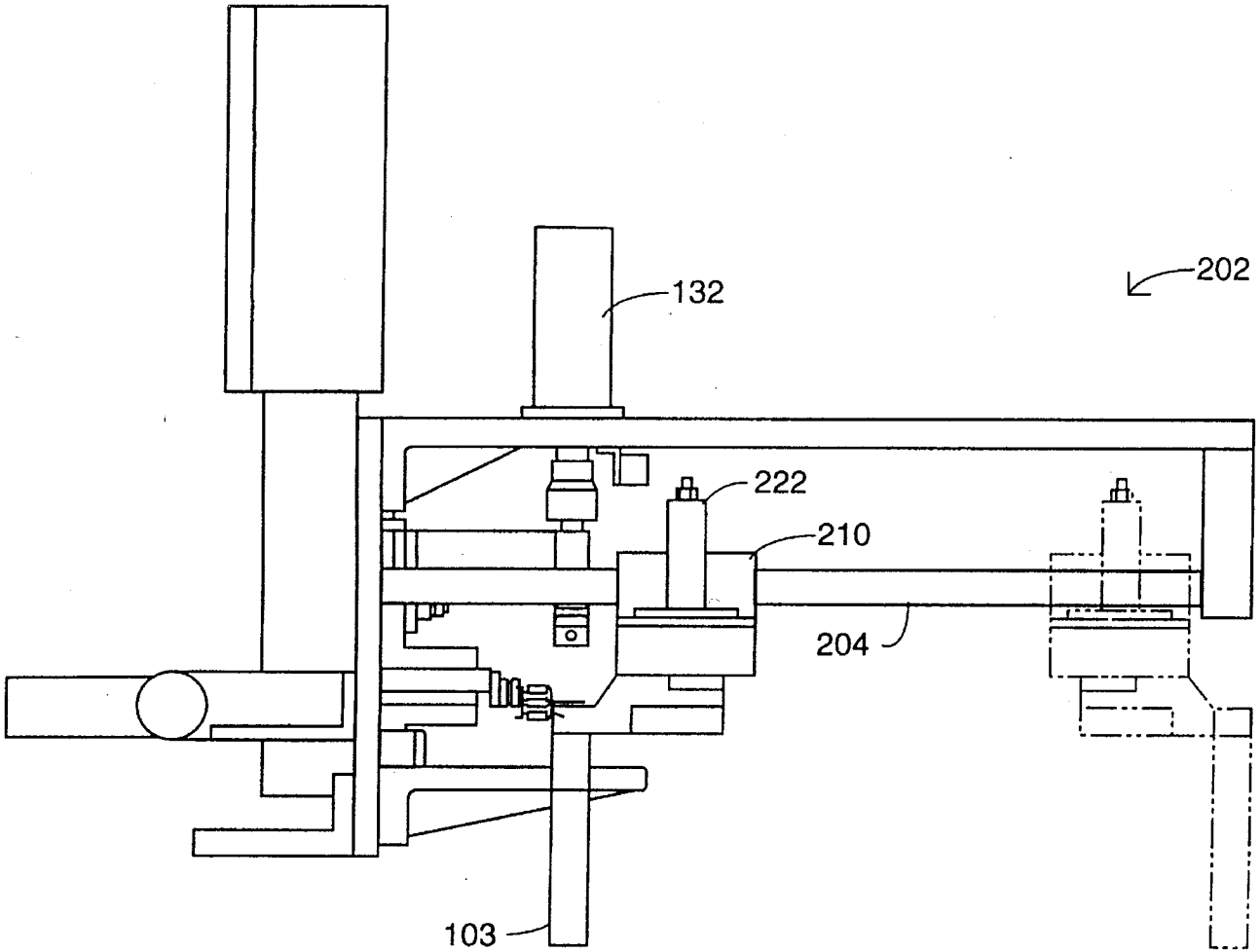
FIG. 4 is a side view of the elastic waist band inverting apparatus shown in FIG. 3.

Turning now to FIG. 3, there is shown an enlarged plan view of the elastic waist band inverting apparatus shown in FIG. 1. The inverting apparatus 200 includes a frame 202 and a pair of parallel rods 204, 206. A slide 210 is mounted onto the frame for movement along the length of the rods 204, 206. A pair of horizontal inwardly-rotating grips 212, 214 are mounted on the opposed ends of slide 210. Each pair of inwardly-rotating horizontal grips include a pair of opposed jaws 216, 218 as previously shown in FIGS. 2D–2E. Jaws 216, 218 are closed by rotary actuators 220. As the slide 210 is moved from position "A" to position "B", the inverter clamps 212, 214 rotate by means of actuator 222 turning the band inside out, the label face is now down with the label on the inside of the loop, to a loading position for transferring the elastic waist band to the elastic waist band loading apparatus 300.

Figure 5:
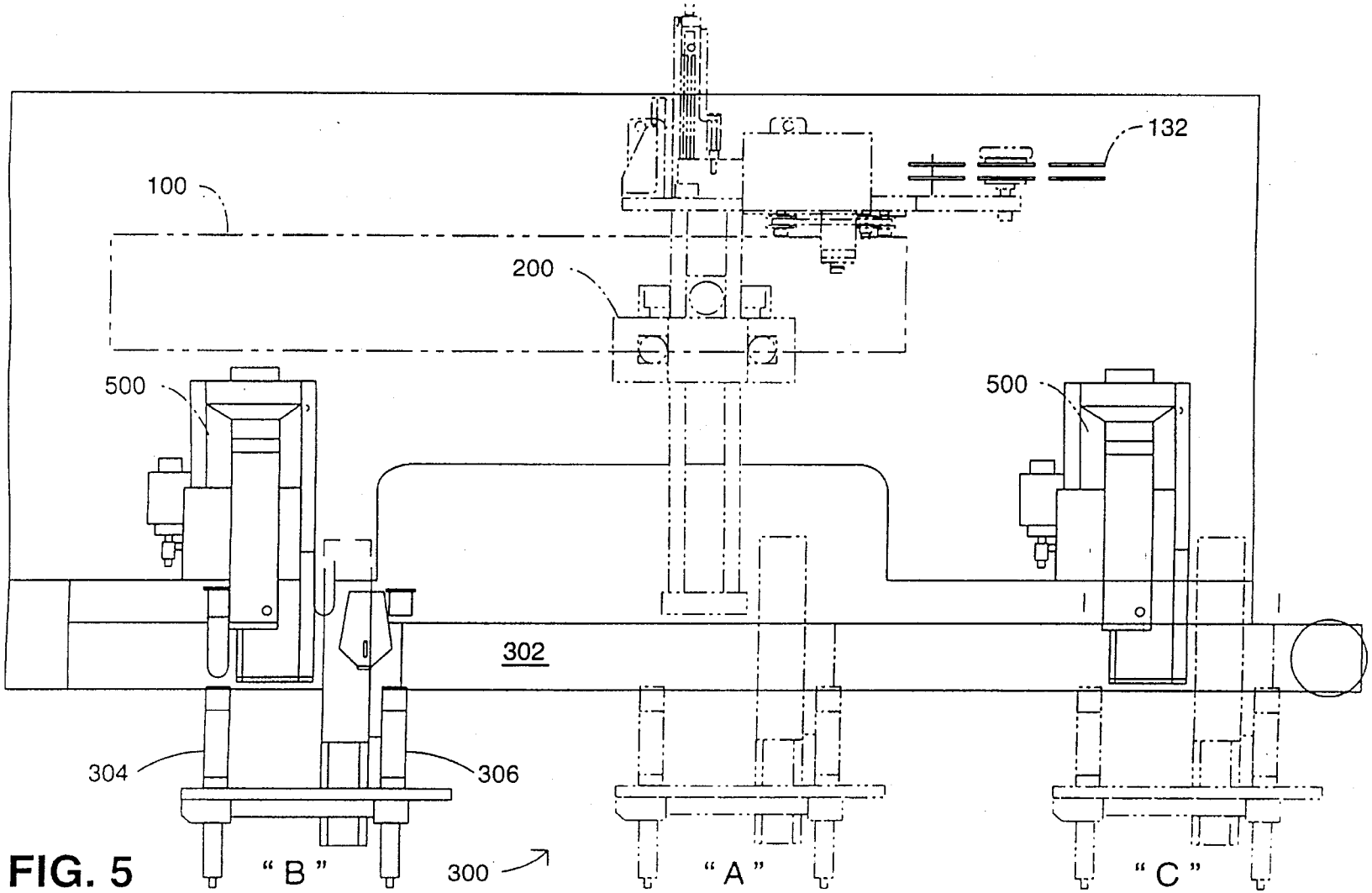
FIG. 5 is an enlarged plan view of the band loading apparatus shown in FIG. 1.

Turning next to FIG. 5, there is shown an enlarged plan view of the band loading apparatus generally designated 300. The elastic waist band loading apparatus 300 includes a frame 302 and a plurality of C-shaped transfer tubes 304, 305, 306 and an actuator 308 for moving the transfer tubes along the frame between an acquiring band position A and load positions B and C located adjacent to each sewing machine 500 as seen in FIGS. 5 and 6.

Figure 6:
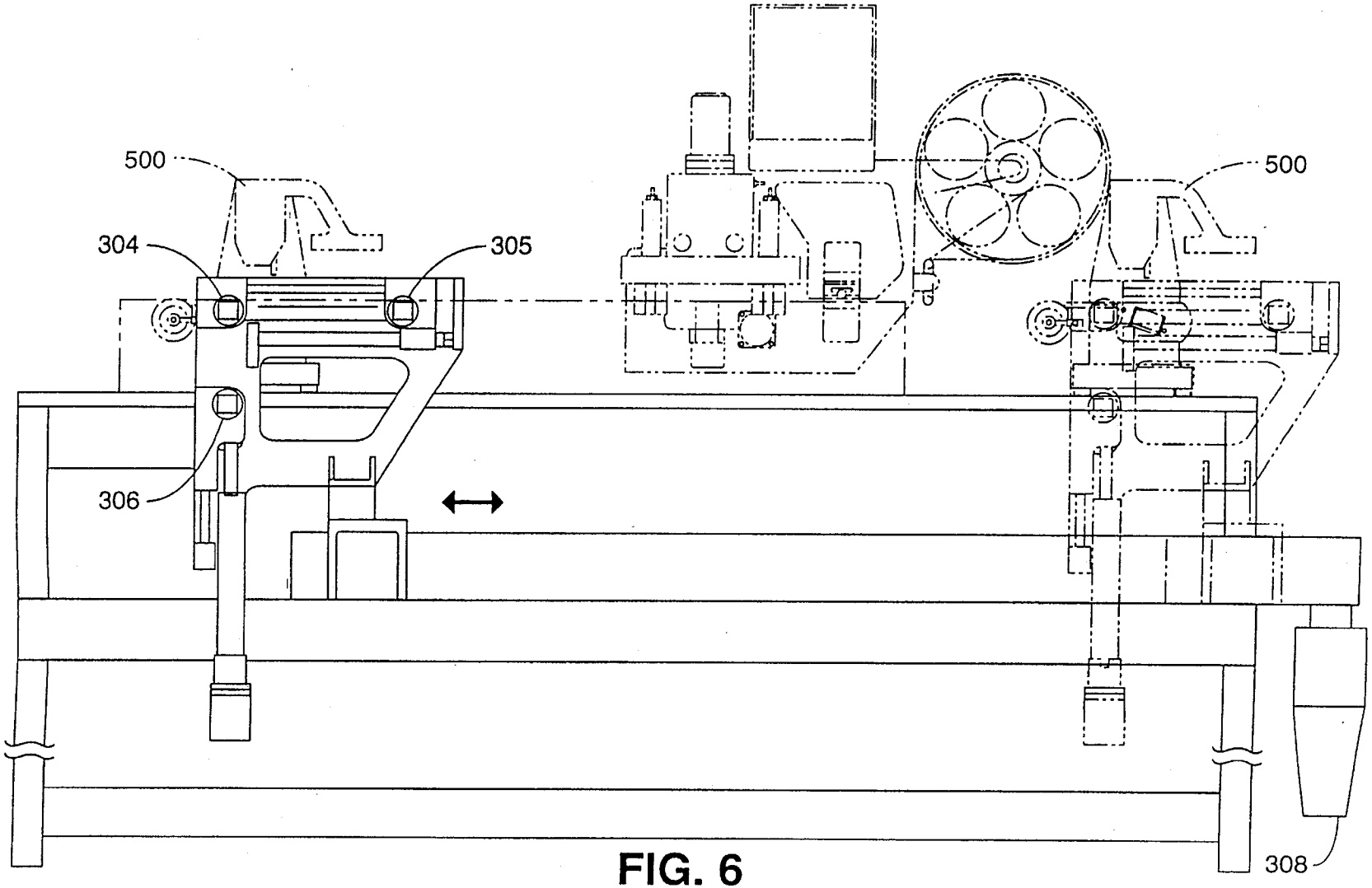
FIG. 6 is a front view of the elastic waist band loading apparatus shown in FIG. 5.
Figure 7A:
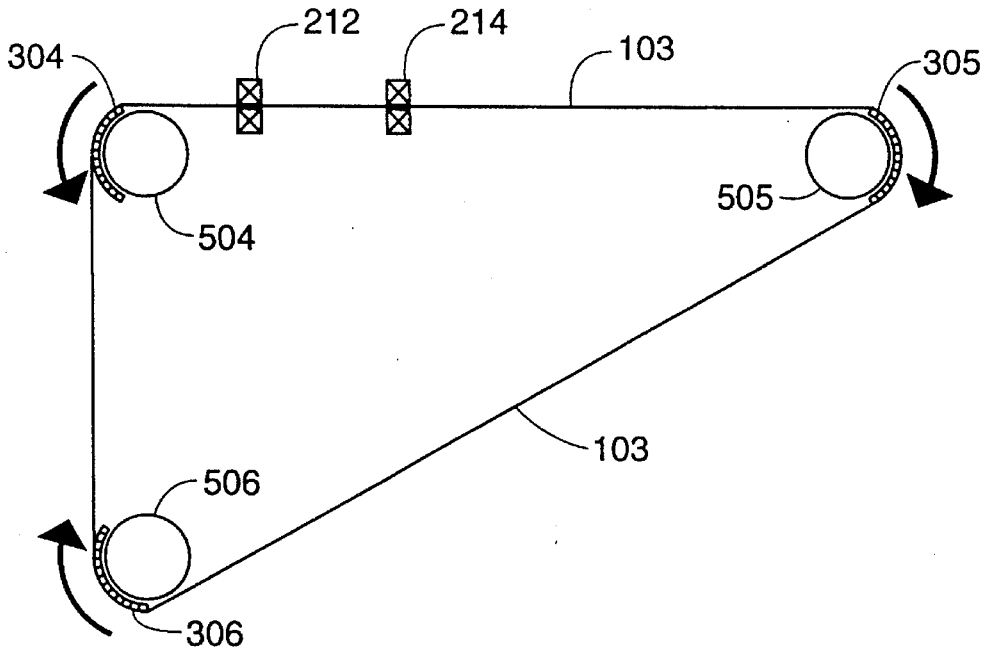
FIGS. 7A–7B illustrate the sequence of operation of the elastic waist band loading apparatus shown in FIGS. 5 and 6.
Figure 7B:
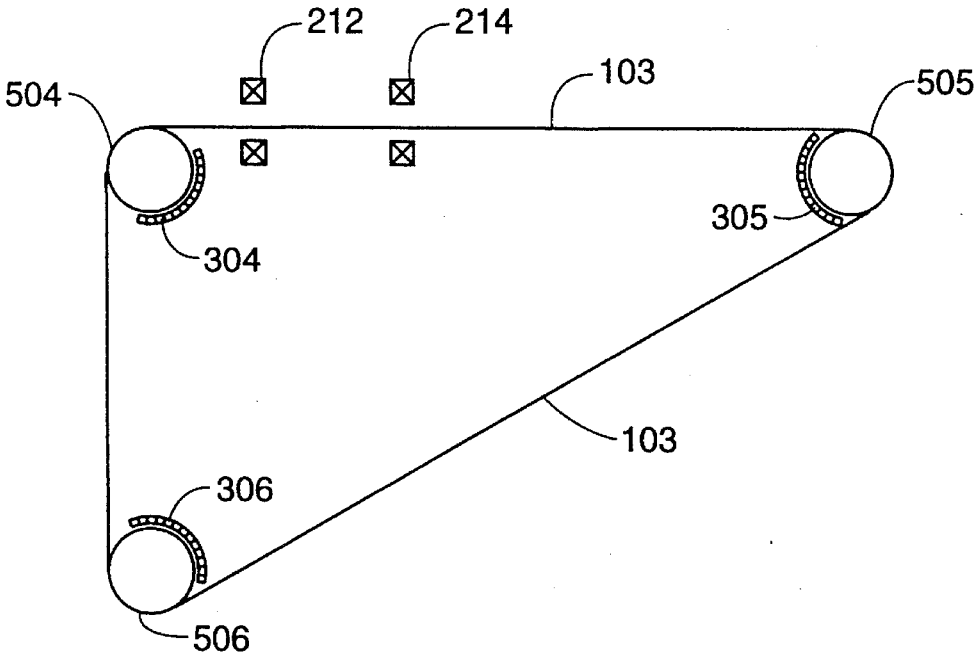
Figure 10:
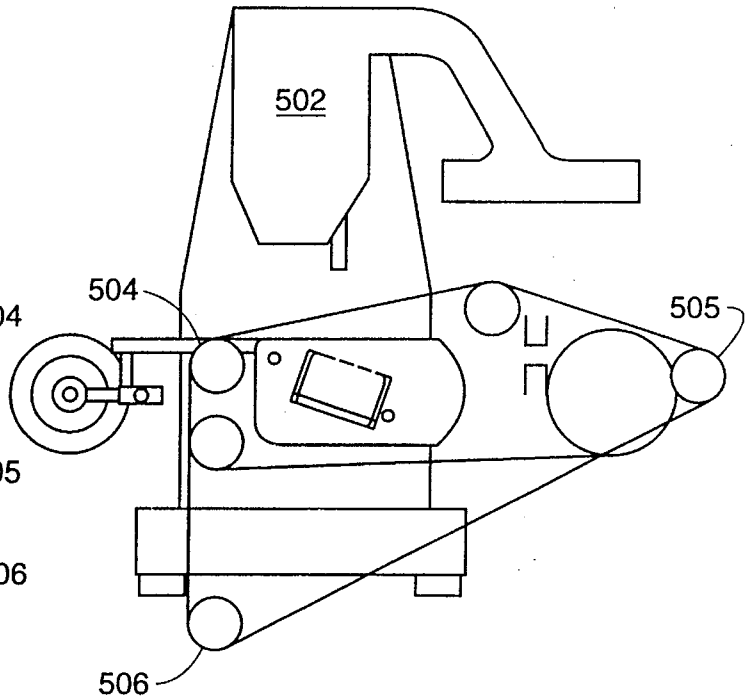
FIG. 10 is an enlarged front view of a sewing machine shown in FIG. 9.

As best seen in FIGS. 7A–7B, there is illustrated the sequence of operation of the elastic waist band loading apparatus shown in FIGS. 5–6. In operation, C-shaped transfer tubes 304, 305, 306 are positioned within elastic band 103 and moved into position while band clamps 212, 214 hold the elastic band in its relative position. Transfer tubes are then moved and positioned with respect to the idle rolls 504, 505 and 506 of each sewing machine 500 (7A). At this point, each of the C-shaped transfer tubes are rotated approximately 180 degrees to transfer the elastic waist band onto idle rolls 504, 505, 506. Elastic waist band clamps 212, 214 are then opened and slide 210 is moved out of position. The band loading apparatus is then moved along frame 302 and is moved into position with one of sewing machines 500 where the sewing operation is completed. A sewing machine adapted to be used in this operation is best seen in FIGS. 9–10 which will be discussed later.

Figure 8A:
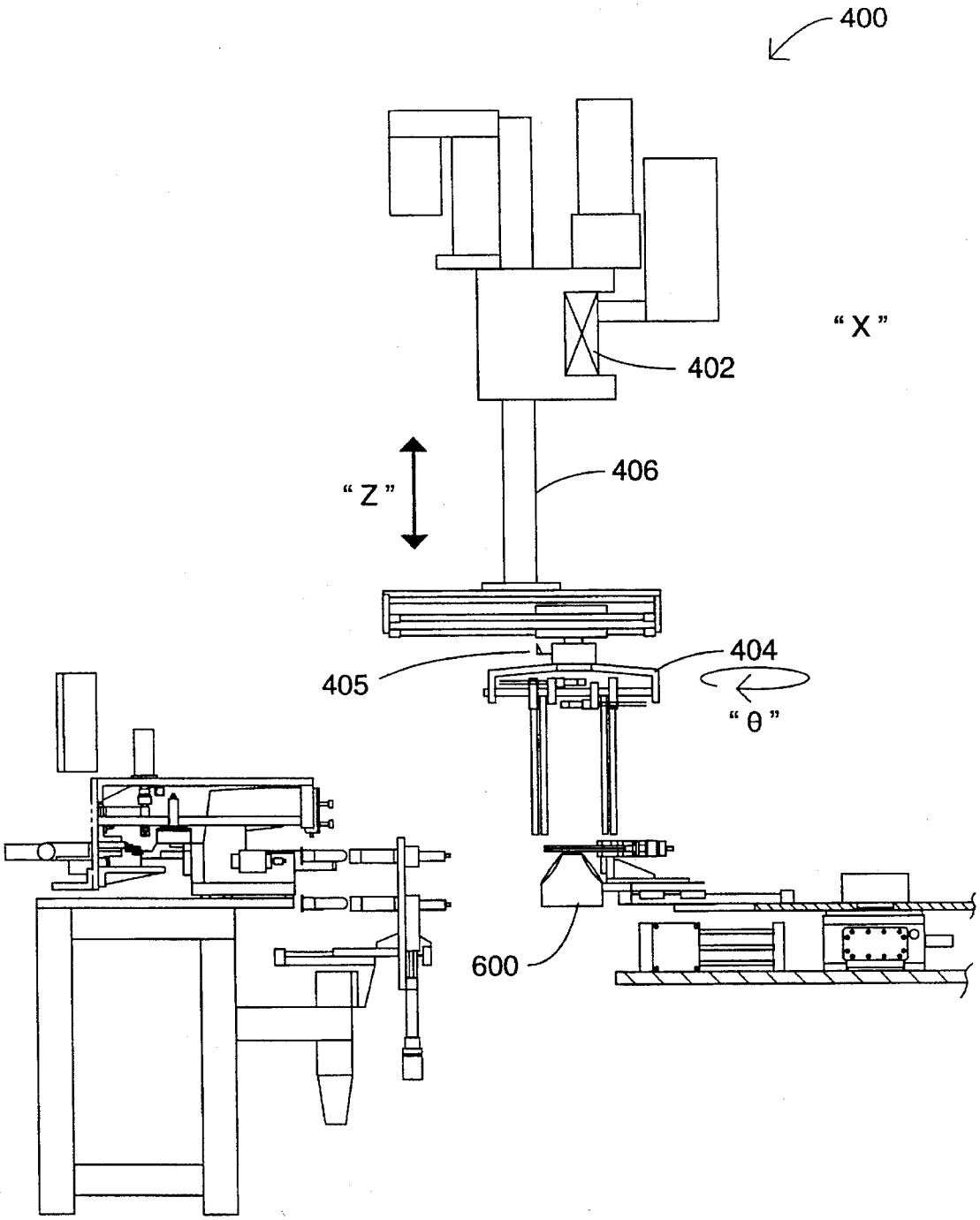
FIGS. 8A–8B are side views of the sew band station illustrating transferring a partially completed brief to the sew band station from an upstream operation.
Figure 8B:
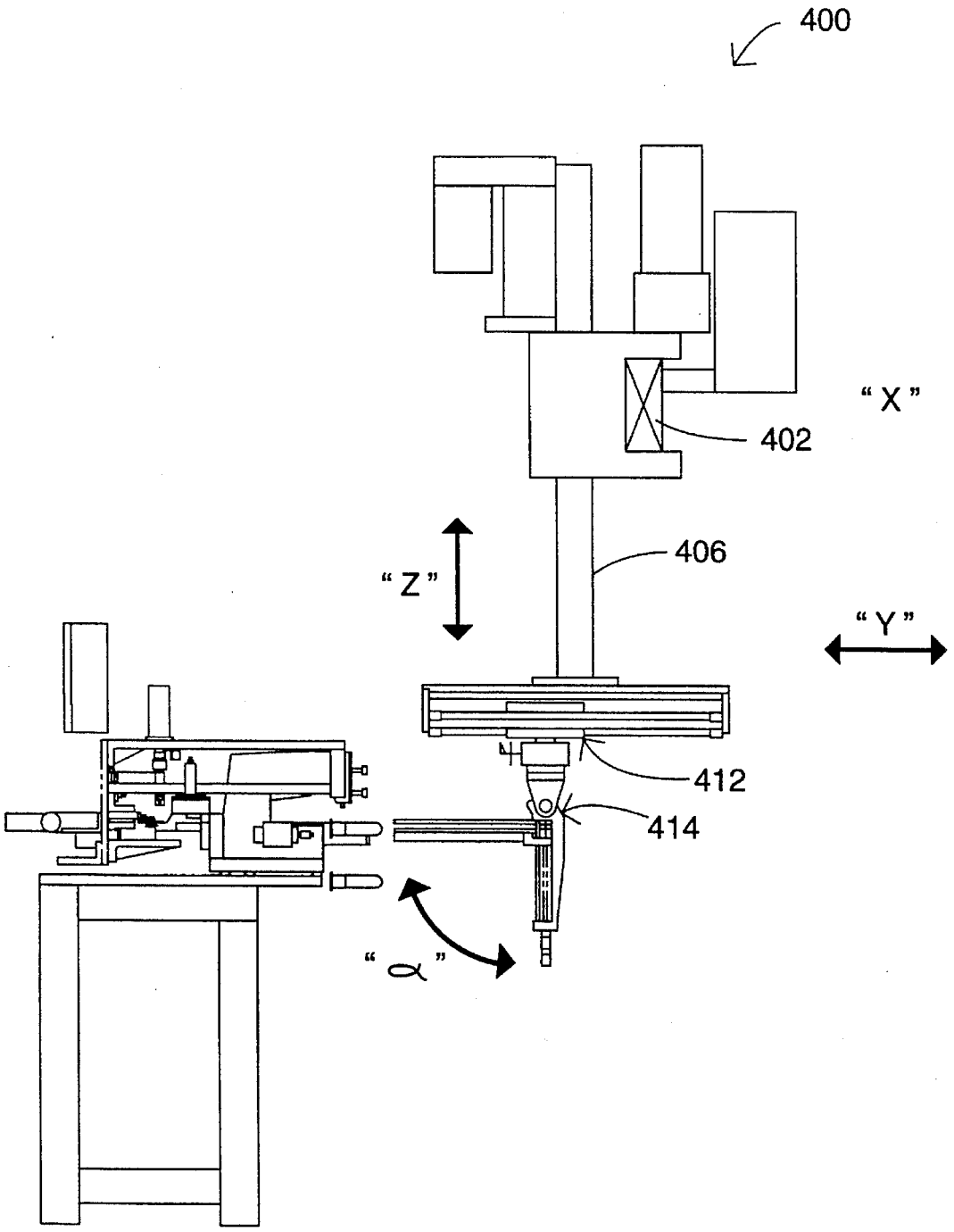

FIGS. 8A–8B are side views of the sew band station 10 illustrating transferring a partially completed brief 600 to the sew band station from an upstream operation such as a seam crotch station. The transfer apparatus includes an overhead frame 402 for allowing movement in the "X" direction which includes gripper finger assembly 404 for removing the briefs from the upstream station and rotating and transferring each brief to the sew band station. Because the brief must be normally moved from an upside down, vertical position to a downstream, horizontal and transposed position, a number of degrees of freedom are necessary. First, the entire apparatus is moved in the "Z" direction by actuator 406. Actuator 405 rotates the brief in the "θ" direction. In addition, after the brief is acquired, the entire brief and gripper assembly 404 must be moved in the "Y" direction by actuator 412. Finally, to move the brief from a vertical to a horizontal position "θ" actuator 414 is used. Accordingly, these multiple operations and multiple degrees of freedom allow the brief to be taken from an inverted position upstream and off-center from the sew band station and rotated and moved in the "X", "Y" and "Z" directions to be properly positioned for sewing the elastic waist band onto the partially completed brief 600.

Figure 9:
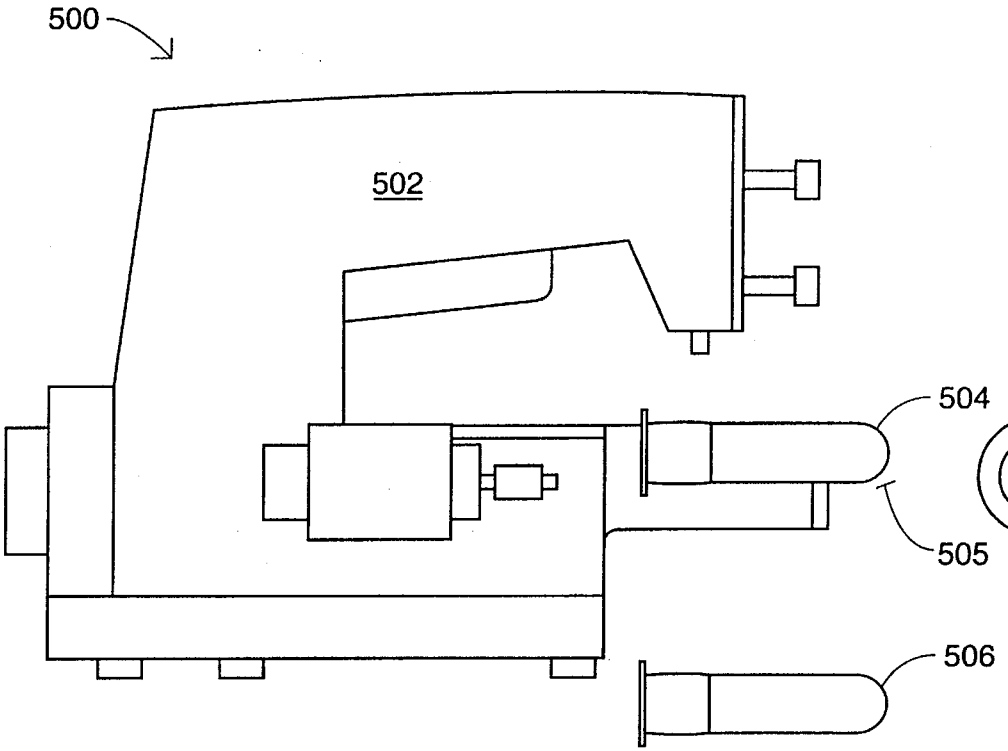
FIG. 9 is an enlarged side view of a sewing machine adapted to be used in the sew band station of the present invention.

Finally turning to FIG. 9, there is shown an enlarged side view of a sewing machine that may be used in the sew band station of the present invention. One machine which is adaptable from a machine which is currently used for attaching presewn bands to this automatic system is manufactured by Union Special, Chicago, Ill. FIG. 10 is an enlarged front view of the sewing machine shown in FIG. 9.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. An apparatus for forming and sewing a waist band to complete a pair of briefs, said apparatus comprising:

(a) a band maker for forming said waist band;

(b) at least one sewing machine adapted to receive said waist band and a pair of briefs and to sew said waist band onto said pair of briefs; and (c) a band inverter and loader for transferring said waist band from said band maker to said sewing machine.

2. The apparatus according to claim 1, further including a transfer assembly for transferring said pair of briefs from an upstream work station to said sewing machine.

3. The apparatus according to claim 2, wherein said transfer assembly for transferring said pair of briefs from said upstream work station to said sewing machine includes an overhead frame and at least two pair of elongated gripping fingers for acquiring said pair of briefs from said upstream work station.

4. The apparatus according to claim 3, wherein said transfer assembly for transferring said pair of briefs from said upstream work station to said sewing machine further includes means for moving said pairs of elongated gripping fingers in the "Y" direction horizontally perpendicular to the sewing direction and "Z" direction vertically perpendicular to the sewing direction to acquire and transfer said pair of briefs from said upstream work station to said sewing machine.

5. The apparatus according to claim 4, wherein said transfer assembly for transferring said pair of briefs from said upstream work station to said sewing machine further includes means for moving said pairs of elongated gripping fingers in the "α" direction in a plane perpendicular to the sewing direction to acquire, move said briefs from a vertical position to a horizontal position and transfer said pair of briefs from said upstream work station to said sewing machine.

6. The apparatus according to claim 5, wherein said transfer assembly for transferring said pair of briefs from said upstream work station to said sewing machine further includes means for moving said pairs of elongated gripping fingers in the "θ" direction in a plane parallel to the sewing direction to acquire, rotate said briefs about a vertical axis and transfer said pair of briefs from said upstream work station to said sewing machine.

7. The apparatus according to claim 4, wherein said transfer assembly for transferring said pair of briefs from said upstream work station to said sewing machine further includes means for moving said pairs of elongated gripping fingers in the "X" direction parallel to the sewing direction to acquire and transfer said pair of briefs from said upstream work station to a plurality of said sewing machines.

8. The apparatus according to claim 1, wherein said sewing machine includes a plurality of idler rolls for receiving said waist band.

9. The apparatus according to claim 1, wherein said band inverter and loader for transferring said waist band from said band maker to said sewing machine includes an inverter sub-assembly located between said band maker and said sewing machine having a frame, a slide attached to and movable along said frame and a pair of rotatable grips for gripping said waist band and inverting said waist band prior to completing the transfer from said band maker to said sewing machine.

10. The apparatus according to claim 9, wherein said band inverter and loader for transferring said waist band from said band maker to said sewing machine further includes a loader sub-assembly located between said inverter sub-assembly and said sewing machine having a frame, a plurality of C-shaped transfer tubes for transferring said waist band from said inverter sub-assembly to said sewing machine and means for moving said C-shaped transfer tubes along said frame between said inverter sub-assembly maker and said sewing machine.

11. The apparatus according to claim 1, wherein said band inverter and loader for transferring said waist band from said band maker to said sewing machine includes a loader sub-assembly located between said band maker and said sewing machine having a frame, a plurality of C-shaped transfer tubes for transferring said waist band from said band maker to said sewing machine and means for moving said C-shaped transfer tubes along said frame between said band maker and said sewing machine.

12. An apparatus for forming a waist band, said apparatus comprising:

(a) means for supplying a predetermined length of elastic band;

(b) a pair of counter rotating band grippers for receiving said predetermined length of elastic band from said supply and rotating to position the ends of said predetermined length of elastic band in end-to-end relationship with respect to one another; and (c) means for joining the ends of said predetermined length of elastic band, wherein said means for joining said ends of said predetermined length of elastic band includes a bottom anvil and a movable labeler having a heater element for fusing said ends under heat and pressure.

13. The apparatus according to claim 12, wherein means for supplying a predetermined length of elastic band includes a pair of opposed rollers and a servo-drive for supplying said predetermined length of elastic band.

14. The apparatus according to claim 12, wherein said means for supplying a predetermined length of elastic band includes a cutter assembly for cutting said predetermined length of elastic band.

15. The apparatus according to claim 12, wherein one of said pair of counter rotating band grippers for receiving said predetermined length of elastic band from said supply and rotating to position the ends of said predetermined length of elastic band in end-to-end relationship with respect to one another includes a fixed stop for positioning one end of said predetermined length of elastic band at a predetermined position.

16. The apparatus according to claim 12, wherein said pair of counter rotating band grippers for receiving said predetermined length of elastic band from said supply and rotating to position the ends of said predetermined length of elastic band in end-to-end relationship with respect to one another includes a movable tensioner rod to tension said predetermined length of elastic prior to joining said ends of said predetermined length of elastic band.

17. An apparatus for forming and sewing a waist band to complete a pair of briefs, said apparatus comprising:

(a) a band maker for forming said waist band, said band maker including: (i) means for supplying a predetermined length of elastic band; (ii) a pair of counter rotating band grippers for receiving said predetermined length of elastic band from said supply and rotating to position the ends of said predetermined length of elastic band in end-to-end relationship with respect to one another; and (iii) means for joining the ends of said predetermined length of elastic band, wherein said means for joining said ends of said predetermined length of elastic band includes a bottom anvil and a movable labeler having a heater element for fusing said ends under heat and pressure;

(b) at least one sewing machine adapted to receive said waist band and a pair of briefs and to sew said waist band onto said pair of briefs;

(c) a band inverter and loader for transferring said waist band from said band maker to said sewing machine; and (d) a transfer assembly for transferring said pair of briefs from an upstream work station to said sewing machine.

18. The apparatus according to claim 17, wherein said sewing machine includes a plurality of idler rolls for receiving said waist band.

19. The apparatus according to claim 17, wherein said band inverter and loader for transferring said waist band from said band maker to said sewing machine includes an inverter sub-assembly located between said band maker and said sewing machine having a frame, a slide attached to and movable along said frame and a pair of rotatable grips for gripping said waist band and inverting said waist band prior to completing the transfer from said band maker to said sewing machine.

20. The apparatus according to claim 19, wherein said band inverter and loader for transferring said waist band from said band maker to said sewing machine further includes a loader sub-assembly located between said inverter sub-assembly and said sewing machine having a frame, a plurality of C-shaped transfer tubes for transferring said waist band from said inverter sub-assembly to said sewing machine and means for moving said C-shaped transfer tubes along said frame between said inverter sub-assembly maker and said sewing machine.

21. The apparatus according to claim 17, wherein said band inverter and loader for transferring said waist band from said band maker to said sewing machine includes a loader sub-assembly located between said band maker and said sewing machine having a frame, a plurality of C-shaped transfer tubes for transferring said waist band from said band maker to said sewing machine and means for moving said C-shaped transfer tubes along said frame between said band maker and said sewing machine.

22. The apparatus according to claim 17, wherein said transfer assembly for transferring said pair of briefs from said upstream work station to said sewing machine includes an overhead frame and at least two pair of elongated gripping fingers for acquiring said pair of briefs from said upstream work station.

23. The apparatus according to claim 22, wherein said transfer assembly for transferring said pair of briefs from said upstream work station to said sewing machine further includes means for moving said pairs of elongated gripping fingers in the "Y" direction horizontally perpendicular to the sewing direction and "Z" direction vertically perpendicular to the sewing direction to acquire and transfer said pair of briefs from said upstream work station to said sewing machine.

24. The apparatus according to claim 23, wherein said transfer assembly for transferring said pair of briefs from said upstream work station to said sewing machine further includes means for moving said pairs of elongated gripping fingers in the "$\alpha$" direction in a plane perpendicular to the sewing direction to acquire, move said briefs from a vertical position to a horizontal position and transfer said pair of briefs from said upstream work station to said sewing machine.

25. The apparatus according to claim 24, wherein said transfer assembly for transferring said pair of briefs from said upstream work station to said sewing machine further includes means for moving said pairs of elongated gripping fingers in the "$\theta$" direction in a plane parallel to the sewing direction to acquire, rotate said briefs about a vertical axis and transfer said pair of briefs from said upstream work station to said sewing machine.

26. The apparatus according to claim 23, wherein said transfer assembly for transferring said pair of briefs from said upstream work station to said sewing machine further includes means for moving said pairs of elongated gripping fingers in the "X" direction parallel to the sewing direction to acquire and transfer said pair of briefs from said upstream work station to a plurality of said sewing machines.

27. The apparatus according to claim 17, wherein means for supplying a predetermined length of elastic band includes a pair of opposed rollers and a servo-drive for supplying said predetermined length of elastic band.

28. The apparatus according to claim 17, wherein said means for supplying a predetermined length of elastic band includes a cutter assembly for cutting said predetermined length of elastic band.

29. The apparatus according to claim 17, wherein one of said pair of counter rotating band grippers for receiving said predetermined length of elastic band from said supply and rotating to position the ends of said predetermined length of elastic band in end-to-end relationship with respect to one another includes a fixed stop for positioning one end of said predetermined length of elastic band at a predetermined position.

30. The apparatus according to claim 17, wherein said pair of counter rotating band grippers for receiving said predetermined length of elastic band from said supply and rotating to position the ends of said predetermined length of elastic band in end-to-end relationship with respect to one another includes a movable tensioner rod to tension said predetermined length of elastic prior to joining said ends of said predetermined length of elastic band.

31. A method for forming and sewing a waist band to complete a pair of briefs, said method including the steps of:

(a) forming said waist band in a band maker;

(b) inverting said waist band;

(c) transferring said waist band from said band maker to a sewing machine;

(d) receiving said waist band and a pair of briefs onto said sewing machine; and (e) sewing said waist band onto said pair of briefs.

32. A method for forming a waist band, said method including the steps of:

(a) supplying a predetermined length of elastic band;

(b) receiving said predetermined length of elastic band from said supply;

(c) rotating said elastic band to position the ends of said predetermined length of elastic band in end-to-end relationship with respect to one another;

(d) preloading said elastic band with a predetermined amount of tension; and (e) fusing the ends of said predetermined length of elastic band with heat and pressure.

33. A method for forming and sewing a waist band to complete a pair of briefs, said method including the steps of:

(a) forming said waist band in a band maker by (i) supplying a predetermined length of elastic band; (ii) receiving said predetermined length of elastic band from said supply; (iii) rotating to position the ends of said predetermined length of elastic band in end-to-end relationship with respect to one another; and (iv) joining the ends of said predetermined length of elastic band;

(b) inverting said waist band;

(c) transferring said waist band from said band maker and said pair of briefs from an upstream work station to a sewing machine;

(d) receiving said waist band and a pair of briefs onto said sewing machine; and (e) sewing said waist band onto said pair of briefs.

* * * * *